US006892852B2

(12) United States Patent
Klein

(10) Patent No.: US 6,892,852 B2
(45) Date of Patent: May 17, 2005

(54) EXHAUST HOUSING PART OF A MOTOR VEHICLE, PARTICULARLY FOR AN EXHAUST MUFFLER OR AN EXHAUST GAS CATALYST

(75) Inventor: Norbert Klein, Nuenkirchen (DE)

(73) Assignee: J. Eberspächer GmbH & Co. KG, Esslingen (DE)

( * ) Notice: Subject to any disclaimer, the term of this patent is extended or adjusted under 35 U.S.C. 154(b) by 481 days.

(21) Appl. No.: 10/074,717

(22) Filed: Feb. 12, 2002

(65) Prior Publication Data

US 2002/0108428 A1 Aug. 15, 2002

(30) Foreign Application Priority Data

Feb. 13, 2001 (DE) ..... 101 06 559

(51) Int. Cl.[7] ..... F01N 7/00

(52) U.S. Cl. ..... 181/227; 181/228; 181/282; 29/890.08; 29/890

(58) Field of Search ..... 29/890.08, 890; 181/227, 228, 282; 72/212; 422/168, 177

(56) References Cited

U.S. PATENT DOCUMENTS

| | | | | | |
|---|---|---|---|---|---|
| 2,187,431 | A | * | 1/1940 | Powell | 29/890.08 |
| 3,064,336 | A | * | 11/1962 | Powers et al. | 29/890.08 |
| 3,279,168 | A | * | 10/1966 | Gerlach | 422/168 |
| 4,905,791 | A | * | 3/1990 | Garey | 181/282 |
| 4,958,701 | A | * | 9/1990 | Moring, III | 181/282 |
| 5,004,069 | A | * | 4/1991 | Van Blaircum et al. | 181/282 |
| 5,036,585 | A | | 8/1991 | Schweinfurth | |
| 5,428,194 | A | * | 6/1995 | Emrick et al. | 181/228 |
| 5,448,831 | A | | 9/1995 | Harwood | |
| 6,135,237 | A | * | 10/2000 | Allman | 181/282 |
| 6,575,267 | B1 | * | 6/2003 | Stiles et al. | 181/282 |

FOREIGN PATENT DOCUMENTS

| | | | |
|---|---|---|---|
| DE | 38 26 707 A1 | 2/1990 | F01N/7/18 |
| DE | 44 37 986 A1 | 4/1996 | B21D/31/06 |
| EP | 0 324 891 | 7/1989 | F01N/7/18 |

* cited by examiner

*Primary Examiner*—Eric Compton

(57) ABSTRACT

In an exhaust housing part of a motor vehicle, particularly for an exhaust muffler or an exhaust gas catalyst of an automobile, with a sheet blank as a semi-finished part which, after a stamping process in a tool, forms an upper half shell or a lower half shell of a half-shell muffler or catalyst; or after a wrapping process in a tool, forms a wrapped exhaust gas funnel or cylinder, or an exhaust gas pipe connection; it is proposed to prefabricate the sheet blank as an integral, profiled sheet metal part of differing thickness, with at least one strip section of smaller thickness, and at least one strip section of greater thickness which locally reinforces the finished exhaust housing part (half shell, funnel, cylinder or pipe connection) at least in one wall region.

9 Claims, 4 Drawing Sheets

EXHAUST HOUSING PART OF A MOTOR VEHICLE, PARTICULARLY FOR AN EXHAUST MUFFLER OR AN EXHAUST GAS CATALYST

CROSS-REFERENCES TO RELATED APPLICATIONS

Not applicable.

STATEMENT REGARDING FEDERALLY SPONSORED RESEARCH OR DEVELOPMENT

Not applicable.

BACKGROUND OF THE INVENTION

The invention relates to an exhaust housing part of a motor vehicle, particularly for an exhaust muffler or an exhaust gas catalyst of an automobile, with a sheet blank as a semi finished part which, after a stamping process in a tool, forms an upper half shell or a lower half shell of a half-shell muffler or catalyst; or after a wrapping process in a tool, forms a wrapped exhaust gas funnel or cylinder, or an exhaust gas pipe connection.

TECHNICAL FIELD

The housing of exhaust mufflers or exhaust gas catalysts for motor vehicles, in half-shell, wrapped, or jacket construction, and also exhaust gas housing parts such as connecting pipes, pipe connections, or connecting funnels, according to the state of the art are constituted, with increased requirements on strength, shape stability, and quality, from sheet blanks which are either single-walled, with large wall thickness, or double-walled, from two sheet blanks. If necessary, additional stiffening ribs or creases in the housing part ensure additional stability. The production of either double-walled housing parts, or also single-walled housing parts with sheet blanks of comparatively large wall thickness, is expensive. Also, much material is required for a sufficiently stable structure of an exhaust gas housing or exhaust gas housing part. High material costs, increased weight of the exhaust gas system, and also higher gasoline consumption of the motor vehicle are disadvantageous.

SUMMARY OF THE INVENTION

The invention has as its object to provide a motor vehicle exhaust housing part, of the kind mentioned at the beginning, with a particular sheet blank as the semi-finished product, and also a production process for a sheet blank, or for an exhaust housing part which has high strength and high shape stability and is nevertheless lightweight.

This object is attained by a sheet blank as a semi-finished part, that after a stamping process in a tool (3, 4, 5), comprises an upper half-shell or a lower half-shell of a half-shell muffler or catalyst; or after a wrapping process in a tool, comprises a wrapped exhaust gas funnel or cylinder, or an exhaust gas pipe connection, wherein the sheet blank (1) comprises an integral, profiled sheet metal part of differing thickness, with at least one strip section of a thickness that locally reinforces the finished exhaust housing part and at least one strip section (10) of a thickness (S2) that locally reinforces the finished exhaust housing part and at least one strip section (11) of greater thickness.

A production process is characterized by at least two profiled press rolls.

A production process of a sheet blank or of an exhaust housing part is characterized by a process for the production of an exhaust housing part with a sheet blank as a semi-finished product with the aid of a production device comprising at least two profiled press rolls, comprising the following steps of prefabricating the sheet blank from a strip material as an integral, profiled rolled sheet metal part of differing thickness and with a thickness (S1) which locally reinforces the manufactured exhaust housing part with at least one strip section (10) of smaller thickness (S2) in at least one wall region.

The essence of the invention is a particular construction of a multi-part sheet blank in a prefabrication for an exhaust muffler, exhaust gas catalyst, exhaust gas funnel, exhaust gas cylinder jacket, exhaust pipe connection or the like to be manufactured in half-shell, wrapped, or jacket construction.

In particular, an exhaust housing part of a motor vehicle, particularly for an automobile exhaust muffler or exhaust gas catalyst, with a sheet blank as a semi-finished product which, after a stamping process in a tool, forms an upper half shell or a lower half shell of a half-shell muffler or catalyst, or after a wrapping process in a tool, forms a wrapped exhaust gas funnel, cylinder, or pipe connection, is characterized by a sheet blank in the form of an integral, profiled sheet metal part of differing thickness, with at least one strip section of smaller thickness, and at least one strip section of greater thickness which locally reinforces the finished exhaust housing part (half shell, funnel, cylinder or pipe connection) at least in one wall region.

The sheet blank preferably has two lateral strip sections of smaller thickness and a strip section lying there between of greater thickness.

The two lateral strip sections of smaller thickness can be of like constitution.

The strip section of greater thickness can additionally include at least one raised, narrow longitudinal web.

If necessary, the rolled sheet metal part has a rolled-in pattern on at least one surface, preferably with longitudinal and/or transverse stripes, diamonds, or circular or square bumps.

The strip sections are in particular constituted linear in the direction of the exhaust housing part to be manufactured.

Alternatively, however, the strip sections can also be widened or narrowed in the middle in the transverse direction of the exhaust housing part to be manufactured, and can have a curved connection edge in the longitudinal direction of the exhaust housing part to be manufactured.

In another embodiment, the strip sections can furthermore have a linear connecting edge, which runs obliquely with respect to the longitudinal direction of the exhaust housing part to be manufactured.

An advantageous rolling device for the production of a sheet blank provides for at least two profiled press rolls, the mutual axial spacing of which is preferably adjustable.

The press rolls are preferably interchangeable for the production of a sheet blank having another profile.

The press rolls can also have interchangeable profiled rolling cylinders or roll cylinder rings, which preferably have a different roll profile and/or a different cylinder diameter.

The press rolls or the roll cylinders or roll cylinder rings can not only be circular in cross section but can also have an at least partially oval shape, in order to form different thicknesses in the transverse direction of a sheet blank.

A process for the production of an exhaust housing part provides in particular for the prefabrication of an integral partially reinforced sheet blank by rolling a strip material.

In particular, the sheet blank is prefabricated from a strip material as an integral, profiled rolled sheet metal part of differing thickness with at least one strip section of smaller thickness and at least one strip section of greater thickness which locally reinforces the manufactured exhaust housing part (half shell, funnel, cylinder or pipe connection) in at least one wall region.

The integral, profiled rolled sheet metal part is, for example, stamped in a stamping tool consisting at least of a stamp and die, in order in particular to constitute an (upper or lower) half shell. It will be understood that the stamp and/or die of the stamping tool is/are correspondingly configured or recessed for the partially thicker sheet blank.

The said sheet blanks can be subjected, not only to a stamping process, but also as a prefabricated semi-finished part to a wrapping process in a corresponding tool, in order to produce exhaust housing parts of wrapped or jacket construction, with partial jacket reinforcement. The wrapped shells, pipes or jackets are preferably provided with a longitudinal weld seam, in particular with a laser weld seam.

Exhaust housing parts, in particular stamped half shells of exhaust mufflers and exhaust gas catalysts, can advantageously be formed by means of the invention in a lightweight construction method, without having to accept losses of strength or of shape stability. The exhaust housing parts are to be partially reinforced in wall thickness, by corresponding enlargement of the profile, only at those places at which special requirements for strength are set. The wall thickness of the sheet blank or of the individual metal sheets is small at all other places, so that with the wall reduction there, a weight reduction and saving of material result overall. According to the state of the art, with single-wall construction of an exhaust gas housing part, a greater thickness, not required per se, of an individual metal sheet or of a sheet blank had also to be provided there, or it was necessary to go over to a double-wall construction. Since the sheet blank itself is not produced by the assembly and welding together of several individual parts, but is produced integrally, no individual parts have to be assembled and welded together, which simplifies the manufacturing process.

The invention is particularly suitable for shell-shaped parts for exhaust mufflers and exhaust gas catalysts, but also in other parts in which a weight reduction is possible by different wall thicknesses while safeguarding the requirements regarding body noise, heat shielding, and durability. Thus half-shell parts of an exhaust system are preferably reinforced partially at selected places for maintaining function, strength, and heat shielding. Before stamping or wrapping, the sheet blanks are already rolled into the final form from metal sheets which are cut to size.

BRIEF DESCRIPTION OF THE DRAWINGS

The invention is described in detail herein below using embodiments with reference to the accompanying drawing.

DETAILED DESCRIPTION OF THE INVENTION

Figure 1:
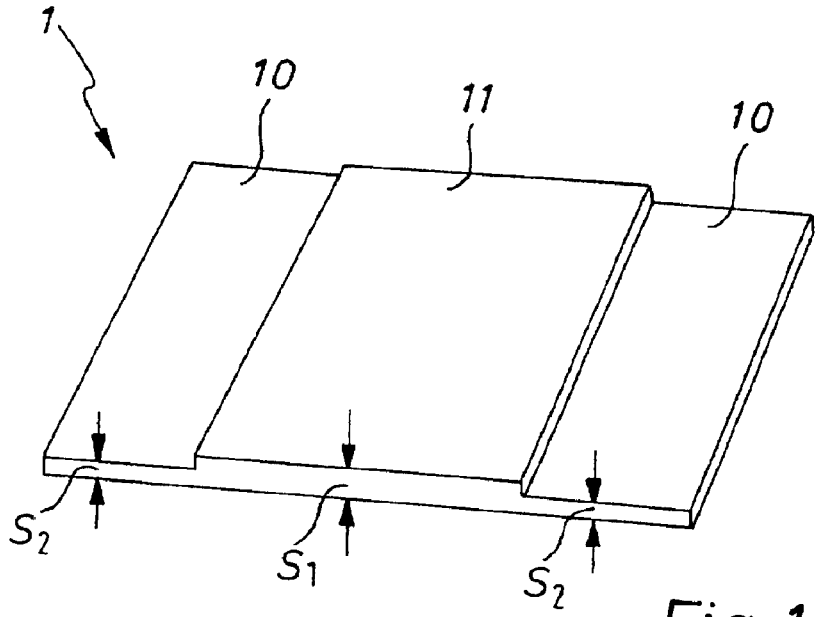
FIG. 1 is a diagram showing, in a schematic perspective view, a roll-pressed sheet blank in a first embodiment variant for the production of a single-walled half shell of an exhaust muffler.

In the drawing, there are shown an exhaust housing part in the form of an exhaust muffler 2 for an exhaust system of a motor vehicle, and also a sheet blank 1 required for manufacture, in different embodiment variants, together with production tools.

The exhaust muffler 2 of half shell construction has an upper and a lower half shell 6 which are securely connected together in their horizontal plane of separation by means of a peripheral fold or an edge weld 20.

The sheet blank 1 for the exhaust housing part or the motor vehicle, in particular for the exhaust muffler 2 or an exhaust gas catalyst of an automobile, has a particular construction which, after a stamping process in a tool 3, 4, 5, forms an upper half shell or a lower half shell of a half-shell muffler or catalyst, or after a wrapping process in a tool, forms a wrapped exhaust gas funnel, cylinder, or pipe connection.

In particular, the sheet blank 1 is an integral, profiled sheet metal part of differing thickness with at least one strip section 10 of smaller thickness S1 and at least one strip section 11 of greater thickness S1 which locally reinforces the manufactured exhaust housing part (half shell, funnel, cylinder or pipe connection) in at least one wall region.

In particular, according to FIGS. 1, 4, 5 and 6, two lateral strip sections 10 of smaller thickness S2 and a strip section 11 lying there between of greater thickness S1 are provided. The two lateral strip sections 10 of smaller thickness S2 are of like construction.

Figure 6:
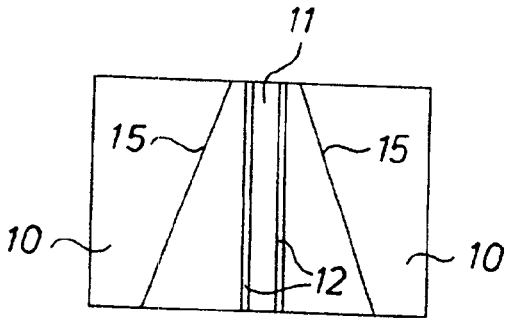

The strip section 11 of greater thickness can be at least a raised, narrower longitudinal web or, according to FIG. 6, additionally include at least one raised, narrow longitudinal web 12.

Figure 8:
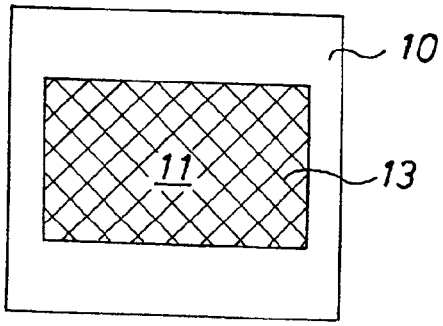

The sheet blanks 1 or the rolled sheet metal part can have, at least on one surface, a rolled-in pattern 13 according to FIG. 8 which can be, for example, longitudinal and/or transverse stripes, diamonds, or circular or square bumps.

The strip sections 10, 11 are preferably linear in the longitudinal direction of the exhaust housing part to be manufactured according to FIG. 1, but can be otherwise configured with a corresponding roll profile of the production tool.

Figure 4:
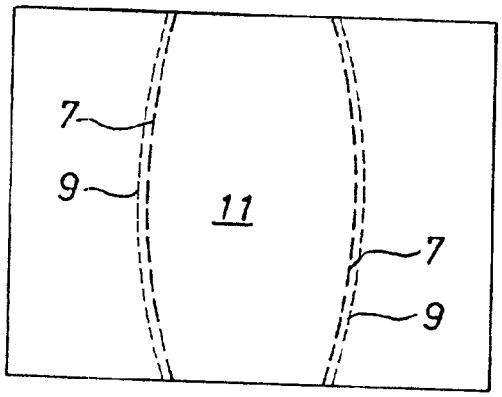
FIGS. 4–8 in schematic plan view, further sheet blanks with differently shaped strip sections of smaller and greater thickness.
Figure 5:
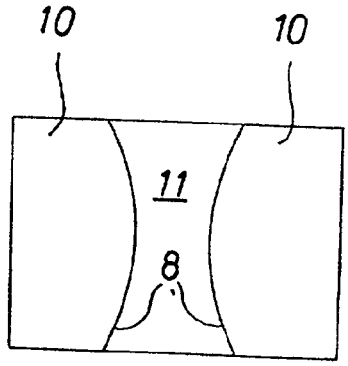

Thus for example the strip sections 10, 11 can be widened or narrowed in the middle in the transverse direction of the exhaust housing part to be manufactured, and can have a curved convex connecting edge 7 according to FIG. 4 or a curved connecting edge 8 according to FIG. 5 in the longitudinal direction of the exhaust housing part to be manufactured. The reference numeral 9 characterizes a rounded transition between the thinner and thicker strip sections 10 and 11.

Figure 7:
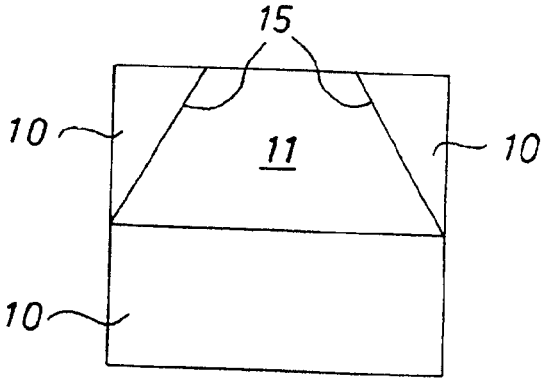

The strip sections 10, 11 can also have a linear connecting edge 15 which runs obliquely with respect to the longitudinal direction of the exhaust housing part to be manufactured, as this is illustrated, for example, in FIGS. 6 and 7.

Figure 9:
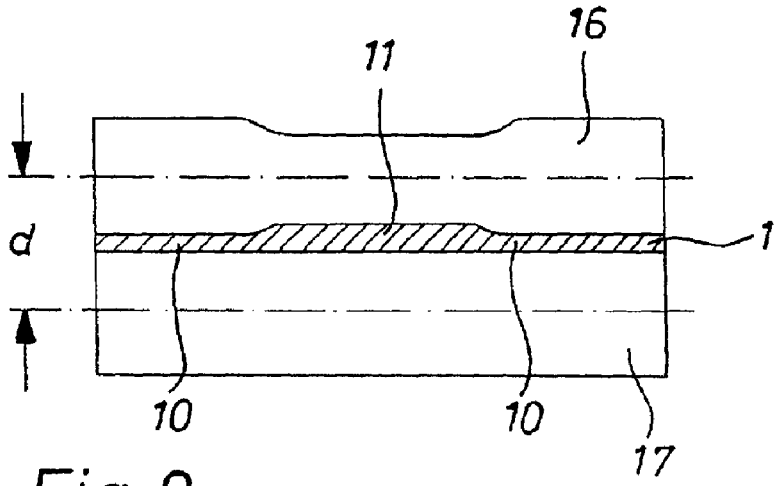
FIGS. 9 and 10 are diagrams showing a rolling device, in two embodiment variants, for the manufacture of a profiled integral sheet blank.
Figure 10:
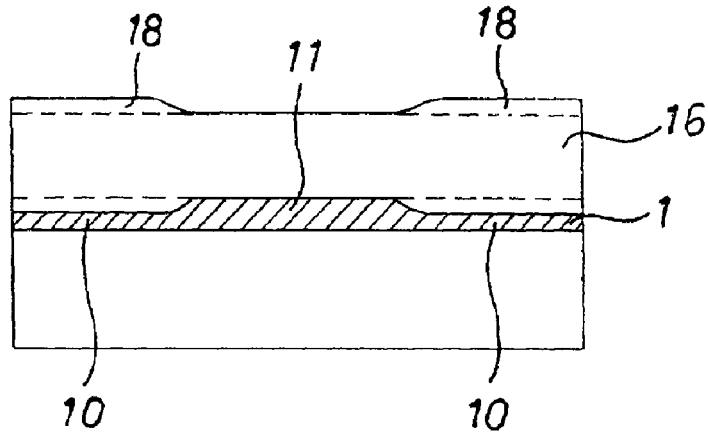
Figure 11:
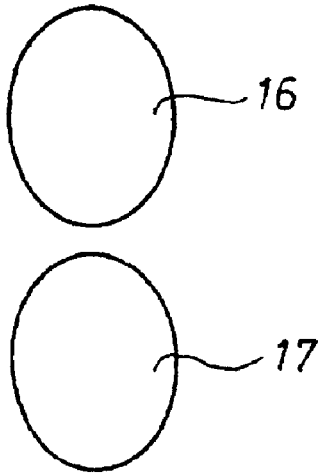
FIG. 11 is a cross sectional diagram of a roll section of press rolls, driven in opposite directions, of the rolling device according to FIGS. 9 and 10.

Variants of a rolling device for the production of a sheet blank 1 are shown in FIGS. 9–11.

In particular, according to FIGS. 9 and 10, two oppositely driven profiled press rolls 16, 17 are provided for, whose profile corresponds to the negative profile of the sheet blank 1 to be produced as shown in FIG. 1.

The distance d between the axes of the two press rolls 16, 17 running mutually axially parallel is adjustable.

The profiled press rolls are preferably interchangeable with press rolls profiled in another fashion.

The press rolls themselves can have interchangeable profiled roll cylinders 18 or roll cylinder rings, as is shown by way of example in FIG. 10 with dashed lines.

The interchangeable roll cylinders 18 or roll cylinder rings have a different rolling profile and/or a different cylinder diameter, in order to be correct for different production profiles and sizes of sheet blanks 1, for example, according to FIGS. 4–8.

The press rolls 16, 17 or the roll cylinders 18 or roll cylinder rings can have a cross section in oval shape over the whole axial length or over an axial partial length, according to FIG. 11, or locally at least one indentation which, in the final form of a stamped or wrapped sheet blank 1, corresponds to a wall reinforcement region.

A process for the production of an exhaust housing part with a sheet blank as semi-finished product provides that the sheet blank 1 is prefabricated from a strip material in a roll device according to FIGS. 9–11 as an integral, profiled rolled sheet metal part of differing thickness with at least one strip section 10 of smaller thickness S2 and at least one strip section 11 with greater thickness S1, the strip section 11 with the greater thickness S1 locally reinforces the manufactured exhaust housing part (half shell, funnel, cylinder or pipe connection) at least in one wall region.

Figure 2:
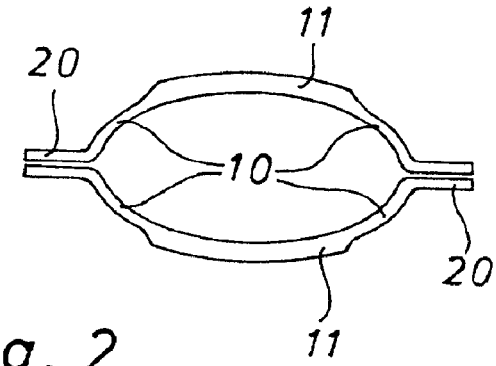
FIG. 2 is a diagram showing, in a schematic cross section, sheet blanks according to FIG. 1 in their final form as stamped half shells.
Figure 3:
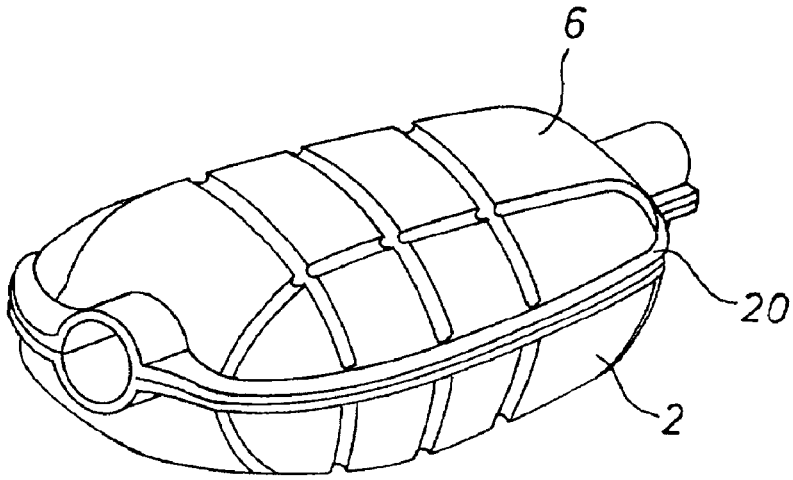
FIG. 3 shows, in a perspective view, an exhaust muffler manufactured with sheet blanks according to FIGS. 1 and 2.
Figure 12:
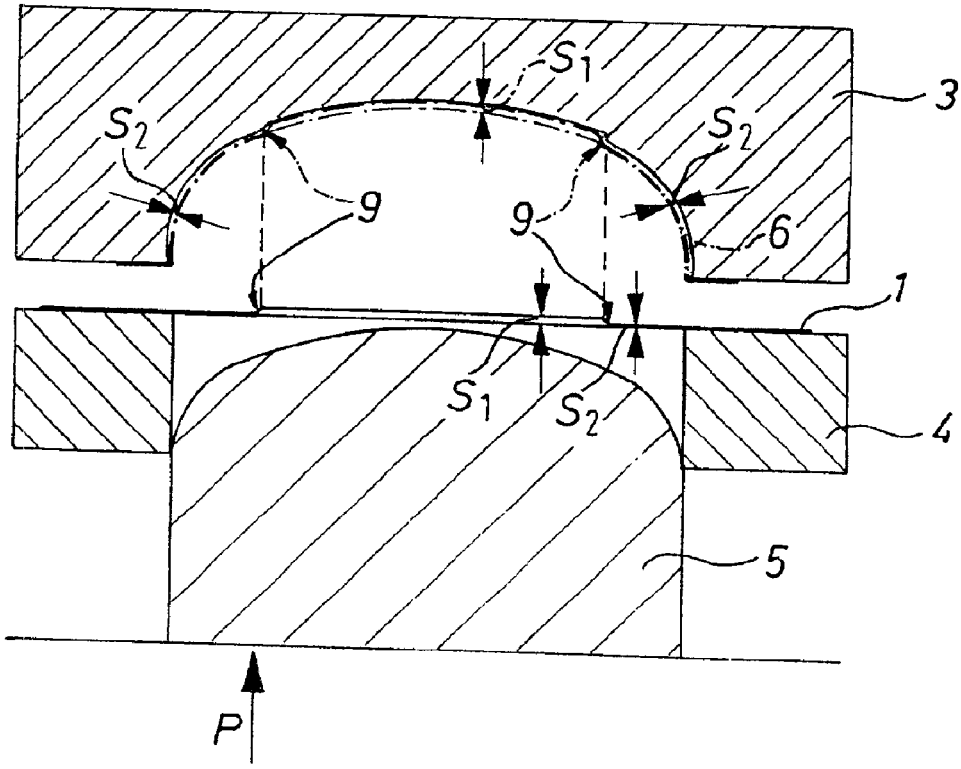
FIG. 12 is a diagram showing a stamping tool for the manufacture of half shell housings from sheet blanks according to FIGS. 1–8.
Figure 13:
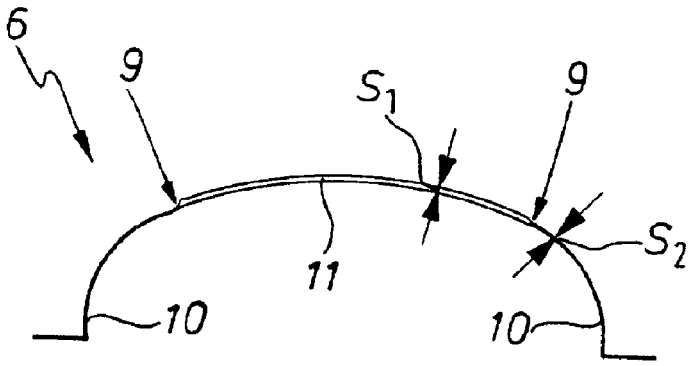
FIG. 13 is a schematic sectional diagram of a sheet blank or manufactured half shell, stamped in the stamping tool according to FIG. 12.

A sheet blank 1 prefabricated in this manner is stamped in a tool according to FIG. 12 into the final form of a half shell 6 according to FIG. 13 or 2.

The tool includes a die 3, a supporting ring 4 and a stamp 5.

The prefabricated sheet blank 1 is positioned beforehand on the supporting ring 4. The die 3 then closes in the direction toward the supporting ring 4, in order to clamp the prefabricated flat sheet blank 1. Thereupon the stamp is moved upward in the direction of the arrow P according to FIG. 14, and carries out the stamping process of the half shell 6 from the semi finished product of the prefabricated sheet blank 1; for stamping, the die 3 together with the supporting ring 4 can also be moved downward against the then stationary stamp 5.

After the conclusion of the stamping process, the sheet blank 1 receives the shape illustrated in the die 3 in FIG. 12.

The said sheet blanks 1 can be subjected, not only to a stamping process, but also, as a prefabricated semi-finished product, to a wrapping process in order to produce wrapped exhaust gas housing parts in wrapped or jacket constructional mode with partial jacket reinforcement. The wrapped shells, pipes or jackets are preferably themselves provided with a longitudinal weld seam, in particular with a laser weld seam.

I claim:

1. An exhaust housing part for an exhaust muffler (2) or an exhaust gas catalyst of an automobile, comprising:

a sheet blank (1) as a semi-finished part that, after a stamping process in a tool (3, 4, 5), comprises an upper half-shell or a lower half-shell of a half-shell muffler or catalyst; or after a wrapping process in a tool, comprises a wrapped exhaust gas funnel or cylinder, or an exhaust gas pipe connection, wherein the sheet blank (1) comprises an integral, profiled sheet metal part of differing thickness, with at least one strip section (10) of a thickness (S2) that locally reinforces the finished exhaust housing part, and at least one strip section (11) of greater thickness at least in one wall region.

2. The exhaust housing part according to claim 1, wherein the sheet blank (1) comprises two lateral strip sections (10) of smaller thickness (S2) and lying there between a strip section (11) of greater thickness (S1).

3. The exhaust housing part according to claim 2, wherein the two lateral strip sections (10) of smaller thickness (S2) are of like constitution.

4. The exhaust housing part according to claim 1, wherein the strip section (11) of greater thickness comprises at least one raised narrow longitudinal web or additionally includes at least one raised narrow longitudinal web (12).

5. The exhaust housing part according to claim 1, further comprising a rolled sheet metal part having a rolled-in pattern (13) at least on one surface.

6. The exhaust housing part according to claim 5, wherein the rolled-in pattern (13) is at least one of longitudinal or transverse stripes, diamonds, or circular or square bumps.

7. The exhaust housing part according to claim 1, wherein the strip sections (10, 11) are linear in a longitudinal direction of an exhaust housing part to be manufactured.

8. The exhaust housing part according to claim 1, wherein the strip sections (10, 11) are widened or narrowed in the middle in the transverse direction of the exhaust housing part to be manufactured and have a curved connecting edge (7 or 8) in the longitudinal direction of an exhaust housing part to be manufactured.

9. The exhaust housing part according to claim 1, wherein the strip sections (10, 11) comprise a linear connecting edge (15) that runs obliquely with respect to a longitudinal direction of an exhaust housing part to be manufactured.

* * * * *